United States Patent [19]

Tsung Ming

[11] Patent Number: 4,762,262

[45] **Date of Patent: * Aug. 9, 1988**

[54] SIDE-FED STAPLER

[76] Inventor: Young Tsung Ming, 5F 1, No. 10-15, 54 Alley, Fu-Hsing Rd., Lu-Chou, Taipei, Taiwan

[ * ] Notice: The portion of the term of this patent subsequent to Dec. 9, 2004 has been disclaimed.

[21] Appl. No.: 860,002

[22] Filed: May 5, 1986

[51] Int. Cl.[4] ..... B25C 5/16

[52] U.S. Cl. ..... 227/120

[58] Field of Search ..... 227/120

[56] References Cited

U.S. PATENT DOCUMENTS

| | | | |
|---|---|---|---|
| 3,302,842 | 2/1967 | MacEachron | 227/120 |
| 3,552,627 | 1/1971 | Moreno | 227/120 |
| 3,680,759 | 8/1972 | Tyszkiewicz | 227/120 |
| 4,151,944 | 5/1979 | Picton | 227/120 |
| 4,199,095 | 4/1980 | Yamanoi | 227/120 |
| 4,569,469 | 2/1986 | Mongeon et al. | 227/120 |
| 4,574,991 | 3/1986 | Thorsen, Jr. | 227/120 |

*Primary Examiner*—E. R. Kazenske
*Assistant Examiner*—James L. Wolfe

[57] ABSTRACT

A stapler includes a press handle, a loading arm for filling a staple stick having a side window thereon, an anvil base and a magazine prefilled with several sticks of staples engaged with the side window of the arm and having an angled spring plate normally braking a staple stick, whereby upon the retraction of a pusher in the arm, the angled spring plate in the magazine will be straightened to release a standby staple stick tensioned by a leaf spring in the magazine to be filled into the loading arm for convenient refilling of staples without uncovering the loading arm.

2 Claims, 2 Drawing Sheets

SIDE-FED STAPLER

BACKGROUND OF THE INVENTION

A conventional stapler is always loaded with staples in a rectangular arm under a press handle for stapling sheets of paper against an anvil base positioned under the arm, which however must be operated to uncover the arm for re-filling new staple stick whenever using up the staples stored inside the arm to cause inconvenience for the stapler user.

The present inventor has found the defect of a conventional stapler and invented the present side-fed stapler.

SUMMARY OF THE INVENTION

The object of the present invention is to provide a stapler including a press handle, a loading arm having a side window adapted for filling staple therethrough, an anvil base and a magazine prefilled with sticks of staples engaged with the side window adapted to automatically supply a staple stick into the arm, to thereby form a stapler with automatic feeding of staples for convenient continuous stapling operations.

DETAILED DESCRIPTION

Figure 1:
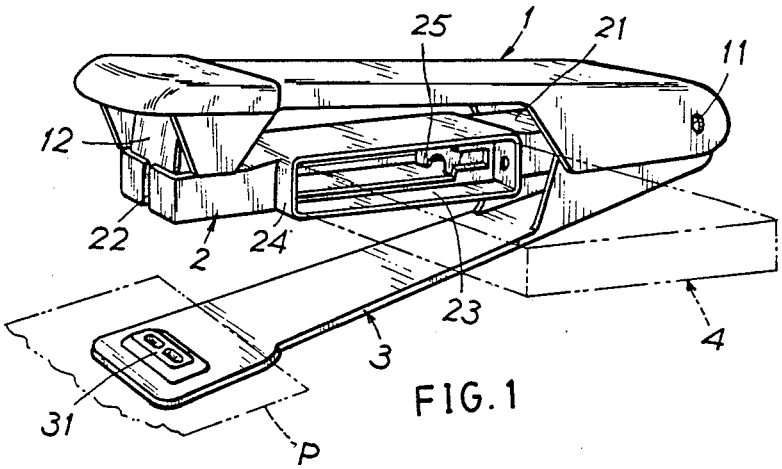
FIG. 1 is a perspective drawing of the present invention.
Figure 2:
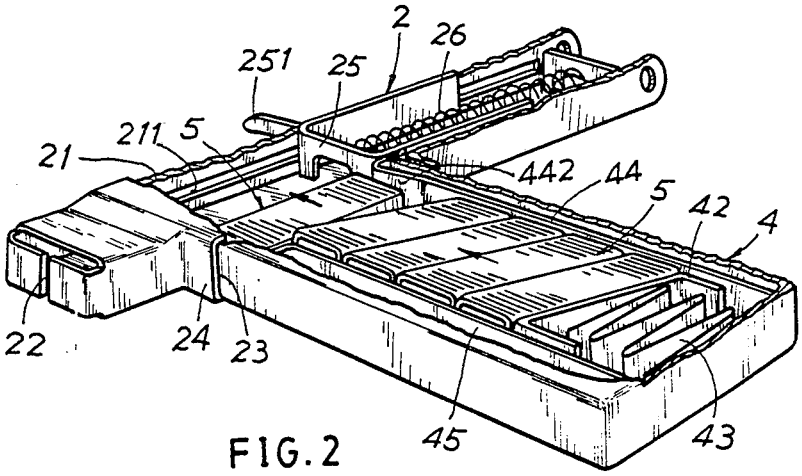
FIG. 2 is a perspective view of a loading arm and a magazine of the present invention.
Figure 3:
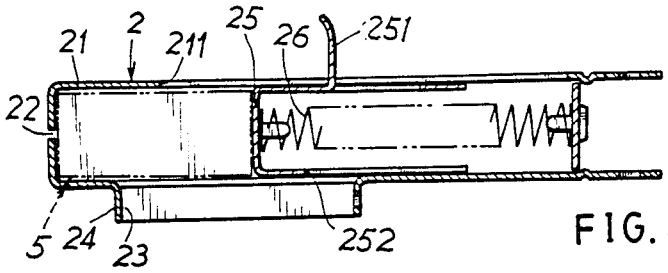
FIG. 3 is a top view of the loading arm of the present invention.
Figure 4:
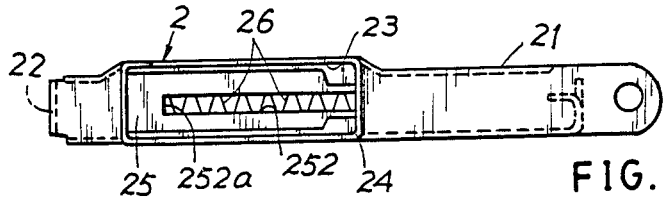
FIG. 4 is a side view showing the loading arm of the present invention.
Figure 5:
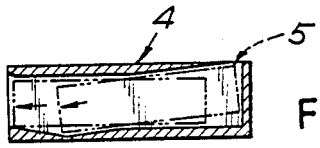
FIG. 5 is a sectional illustration of mangzine of the present invention.

As shown in the figures, the present invention comprises: a press handle 1 having a pivot 11 formed on its inner end and a driver 12 formed on its outer end, a loading arm 2 filled with a staple stick 5 as pivotedly mounted under the handle 1, an anvil base 3 having an anvil 31 formed its outer end pivotedly mounted under the arm 2, and a magazine 4 consecutively prefilled with sticks of staples 5 inserted on a side portion of the arm 2.

The loading arm 2 includes a rectangular tray 21 adapted for filling a staple stick 5 having a longitudinal slot 211 formed on the rear side wall of the tray 21, a punching guide 22 formed on the outer end of the tray 21 adapted for guiding a staple as pressed by the driver 12 of handle 1 for stapling stack of papers P against the anvil 31, a side window 23 defined by a coupling receptacle 24 disposing around the window 23 formed on the front side wall of tray 21, a U-shaped pusher 25 resiliently pushing stick staple outwardly in the tray 21 as restored by a spring 26 inserted in the tray 21 and having a handle lug 251 formed on the rear side of the pusher 25 and reciprocatively moving within the slot 211 and having a second longitudinal slot 252 formed on the front side of the pusher 25. The side window, of course, may be manually refilled with a staple stick without the magazine 4.

Figure 6:
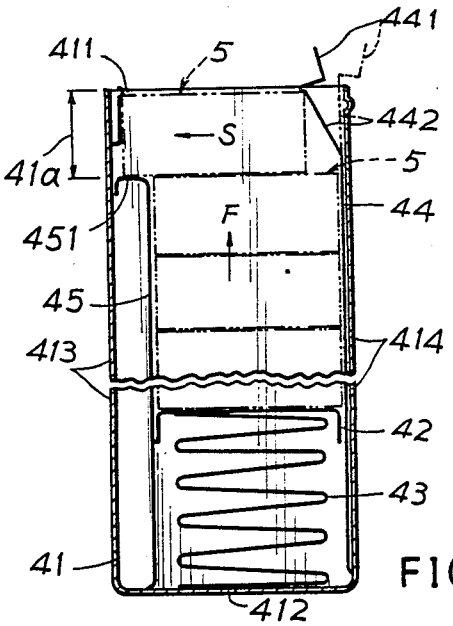
FIG. 6 is a top-view illustration of the magazine of the presnet invention.

The magazine 4 includes: a rectangular case 41 having an opening end 411 formed on its one side engaged with the receptacle 24 of side window 23, a closed end-wall 412 formed on the other side opposite to the opening 411, a left side-wall 413 and a right side-wall 414; a staple partition plate 45 longitudinally formed in the case 41 parallelly approximate to the left side-wall 413 adapted to define several consecutive sticks of staples 5 with the right side-wall 414 as shown in FIG. 6; a pusher plate 42 retained by a leaf spring 43 adjacent to the closed end-wall 412 resiliently pushing the stick staples towards the side window 23 (direction F); and an angled spring plate 44 having a striker end portion 441 protruding outwardly fixed on the right side-wall 414 near the opening end 411. The angled spring plate 44 normally transversely biases a staple stick 5 leftwards (direction S) against the left side-wall 411.

The striker end portion 441 is operatively pulled inwardly by the outer edge **252*a* of slot 252 when retracting the lug 251 and pusher 25 so as to straighten the angled portion 442 as shown in dotted line as shown in FIG. 6, whereby the staple stick 5 will now longer be resiliently held against the side-wall 411 near the opening end 411 and will be forwarded into the tray 21 as restored by spring 43 adapted to push outwardly by the pusher 25 for a stapling operation, without uncovering the handle 1 above the arm 2**.

When the staple stick 5 is further pushed outwardly by the pusher 25 for stapling papers P, the striker end portion 441 is not pulled by the pusher edge **252*a* and the angled spring plate 44 will be recovered to bias the next staple stick in direction S against the side-wall 411 to counteract the resilient force exerting by the leaf spring 43 to prevent its side frictional force retarding the outward movement of the pusher 25 for normally stapling operation. The partition plate 45 has a length less than the length of the case 41 by a staple width 41*a* as shown in FIG. 6 and is formed with a bending end plate 451 on its opening end to guide the outermost staple stick 5 ready for next filling (forwarding) into the tray 21. The width of the case 41 (width between the two side-walls 413 and 414) should be slightly larger than the length of a staple stick 5 to allow the outermost "standby" staple stick being biased by the spring plate 44**.

In normal stapling operation, upon the depressing of the handle 1 the driver 12 will punch downwardly a staple in front of the arm 2 to staple stack of papers P as padded by the anvil 31 of base 3. Once using up the staples, the handle lug 251 is retracted to allow the new staple stick 5 being refilled from the magazine 4 as aforementioned into the tray 21 for automatic refilling of staples.

What is claimed is:

1. A side-fed stapler comprising:

a press handle having a driver formed on its outer end;

a loading arm filled with a staple stick pivotedly mounted under said arm; a base, having an anvil, pivotedly formed under said arm; and a magazine consecutively prefilled with several staple sticks inserted on a side portion of said loading arm, whereby upon the pressing of said handle, said driver will punch a staple in front of said loading arm to staple a stack of papers as padded by said anvil of said base;

the improvement which comprises:

said loading arm including a rectangular tray having a longitudinal slot formed on its rear side wall, a side window defined by a coupling receptacle disposing around said window, and an U-shaped pusher having a handle lug protruding rearwards reciprocatively moving within said longitudinal slot and having a second longitudinal slot formed on a front side of said pusher, said U-shaped pusher resiliently biased by a spring inserted in said tray to operatively push a staple stick outwardly for stapling operation; and said magazine including a rectangular case consecutively prefilled with several staple sticks as resiliently biased by a leaf spring formed in the case, said case having an opening end engaged with said side window and inserted into said coupling receptacle of said side window of said loading arm, and having an angled spring plate fixed on a side wall of said case near its opening end normally transversely biasing a staple stick against an opposite side wall, said angled spring plate having an angled portion and a striker end portion adapted to be pulled by an edge of said second longitudinal slot of said pusher, whereby upon the retraction of said pusher, said striker end portion will be retracted to straighten said angled spring plate to allow a standby staple stick being filled into said tray as retained by said leaf spring.

2. A stapler according to claim 1, wherein said magazine includes a staple partition plate having a length shorter than the case length by a staple width and longitudinally formed in the case parallelly proximate to a side wall of said case, and having a bending end portion formed on its opening end to guide a staple stick as biased by said angled spring plate, said rectangular case having a width slightly larger than a length of said staple stick.

* * * * *